United States Patent [19]

Geurtsen et al.

[11] 4,000,690

[45] Jan. 4, 1977

[54] PRINTING CODER

[75] Inventors: Friedrich Henri Herman Geurtsen, Holliston; Maurice Désiré Pichel, Milford, both of Mass.

[73] Assignee: Dennison Manufacturing Company, Framingham, Mass.

[22] Filed: May 1, 1975

[21] Appl. No.: 573,725

[52] U.S. Cl. ..... 101/36; 101/350

[51] Int. Cl.[2] ..... B41F 17/00

[58] Field of Search ..... 101/35–37, 101/DIG. 3, DIG. 6, DIG. 11, 327–332, 349–352, 216

[56] References Cited

UNITED STATES PATENTS

| | | | |
|---|---|---|---|
| 140,219 | 6/1873 | Schacht | 101/216 |
| 147,630 | 2/1874 | Hursy et al. | 101/216 |
| 168,115 | 9/1875 | Tuchfarber | 101/216 |
| 1,560,764 | 11/1925 | Collison et al. | 101/36 |
| 2,040,525 | 5/1936 | Mumma et al. | 101/37 |
| 2,169,681 | 8/1939 | Dudley | 101/350 |
| 2,632,383 | 3/1953 | Gottscho et al. | 101/35 |
| 2,711,935 | 6/1955 | Miles | 101/349 X |
| 2,751,843 | 6/1956 | Faeber | 101/349 |
| 3,179,043 | 4/1965 | Mellison | 101/35 |
| 3,345,941 | 10/1967 | Koch et al. | 101/350 |
| 3,529,545 | 9/1970 | Gartside | 101/349 X |
| 3,685,442 | 8/1972 | Harwell, Jr. | 101/35 X |
| 3,760,723 | 9/1973 | Taig | 101/330 X |

OTHER PUBLICATIONS

"Ultra-Mark Top Coder", Control Print Corporation Systems Specification Manuel, pp. 1–41, H–C Industries, 6/72.

*Primary Examiner*—E. H. Eickholt
*Attorney, Agent, or Firm*—Donald Brown

[57] ABSTRACT

A coder for imprinting the tops of crowns, closures or the like which includes a floating print roll which is independently fine turnable to accomodate height variations in the items being encoded, said print roll being lever supported for quick release from an ink metering roll upon being raised by the item to be imprinted. The print roll is rotatably driven by the items to be imprinted and the metering roll and inking roll of the coder are both preferably driven to relieve wear between the inking and metering rolls.

16 Claims, 8 Drawing Figures

PRINTING CODER

BACKGROUND OF THE INVENTION

This invention is directed to a new and improved printing coder of the type which is generally termed a top coder and which is normally used for printing on the top of crowns or closures of containers such as bottles, cans or the like fed to it on a conveyor or the like.

It should be understood that the present invention is also capable of printing on sides or bottoms of containers or labels or the like carried thereby which are conveyed to the printing roll thereof in a manner as shown herein.

The present invention finds utility in supermarkets, warehouses and etc., in which a number of substantially identical containers must be coded with indicia, e.g., printed numbers, letters, etc., be it visible or invisible indicia, for the purpose of identifying the container or placing the price on the container.

The present invention provides the following advantages:

1. it eliminates the problem of constant printing on the same container during conveyor stoppage and/or production surges;

2. it permits for simplified adjustment or fine tuning of the print roll to accommodate small differences in container height;

3. it securely, independently holds the floating print roll for pivotal motion in a manner so as to reduce the force required to lift the print roll prior to printing on the container as well as to insure that the print roll cannot fall off from its support; and

4. it provides for means to reduce the wear of the metering roll, as well as means to independently adjust the pressure between the inking roll and the metering roll.

BRIEF DESCRIPTION OF THE DISCLOSURE

The coder of the present invention comprises in its preferred form a floating printing roll mounted for rotation between the ends of a lever. The lever is fixedly pivotally supported at one end to a support member and at its opposite end is pivotally mounted to a rod which is slidable in said support member.

A spring is positioned about the rod to resiliently bias and urge the lever end coupled to the rod away from the support member. The support member is adjustably mounted so as to permit fine adjustment or fine tuning of the print roll with respect to containers carried on a conveyor and being fed under the print roll.

In the preferred form of the present invention, the inking roll and metering rolls are driven to reduce wear between said rolls.

In addition, the metering roll is independently adjustable with respect to the other rolls in order to alter the pressure between rolls.

DETAILED DESCRIPTION OF THE DISCLOSURE

Figure 1:
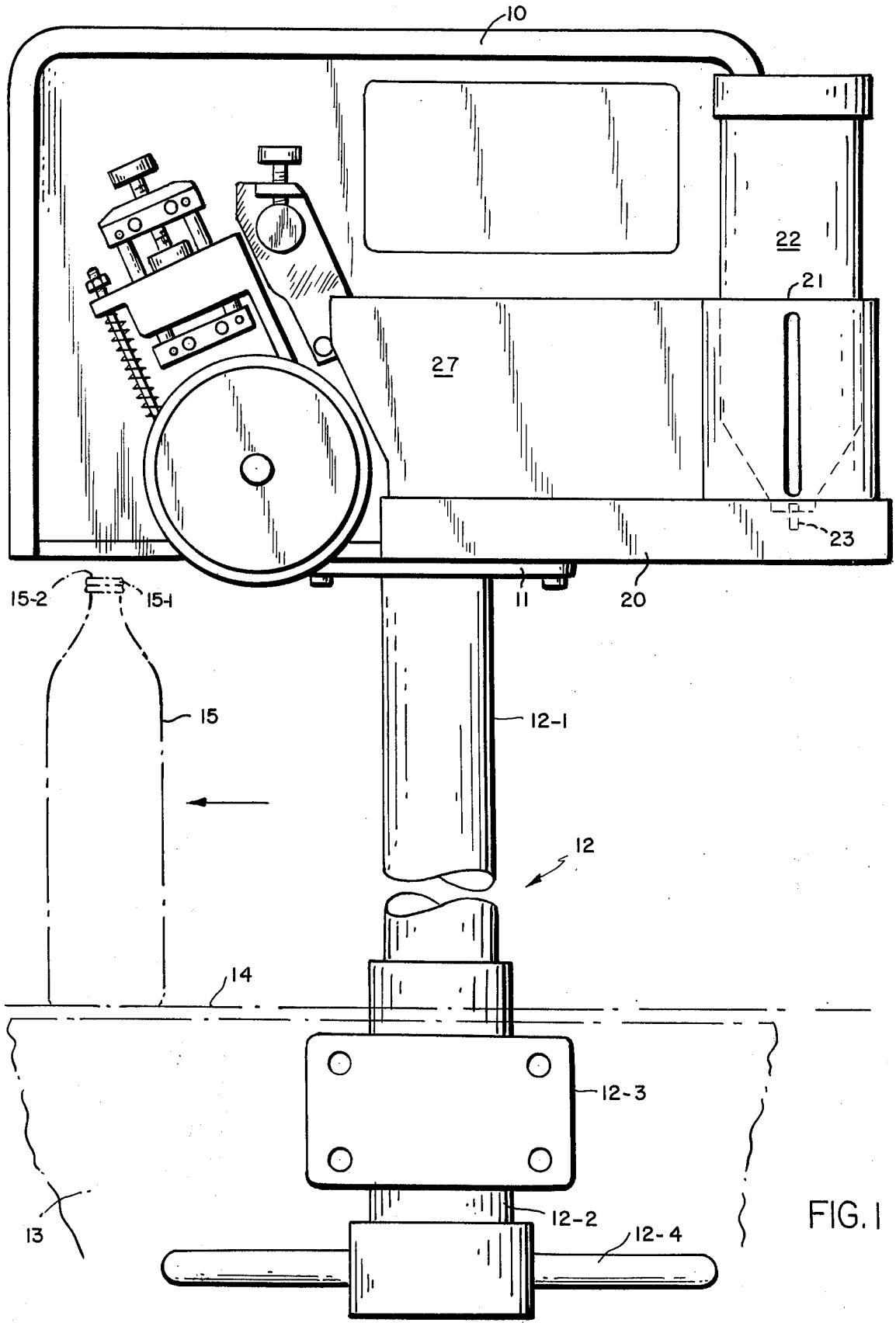
FIG. 1 is a front view of the coder of the invention.

Reference should now be had to the FIGS. 1–8 for a detailed description of the invention. The coder is shown at 10 in FIG. 1 and is supported by a platform 11 to which it is bolted. The platform 11 is supported by a jack member 12 which positions the top coder 10 with respect to a conveyor belt 14 of a conveyor 13. The conveyor belt 14 is normally driven as is conventional in the art to present containers 15 to the coder for printing thereon.

The jack 12 comprises a first conventional member 12-1 threaded at its bottom which is inserted in a threaded bore of a member 12-2. The member 12-2 is supported for rotation by bracket 12-3 fixed to the conveyor 13. A handle 12-4 is provided to rotate member 12-2 to cause member 12-1 to be raised or lowered.

The coder 10 includes an ink well or reservoir 20 and a bottle holder 21 for positioning an ink bottle 22 above the well 20.

A conventional hollow tube (shown dotted at 23) supported by the well 20 is provided. The tube 23 is insertable into the cap of the bottle 22 to direct drops of ink into the reservoir in a conventional manner.

Adjacent the reservoir there is provided a cover 27. The cover 27 is not shown in full in FIGS. 2–6 in order to illustrate the operating parts of the coder.

Figure 3:
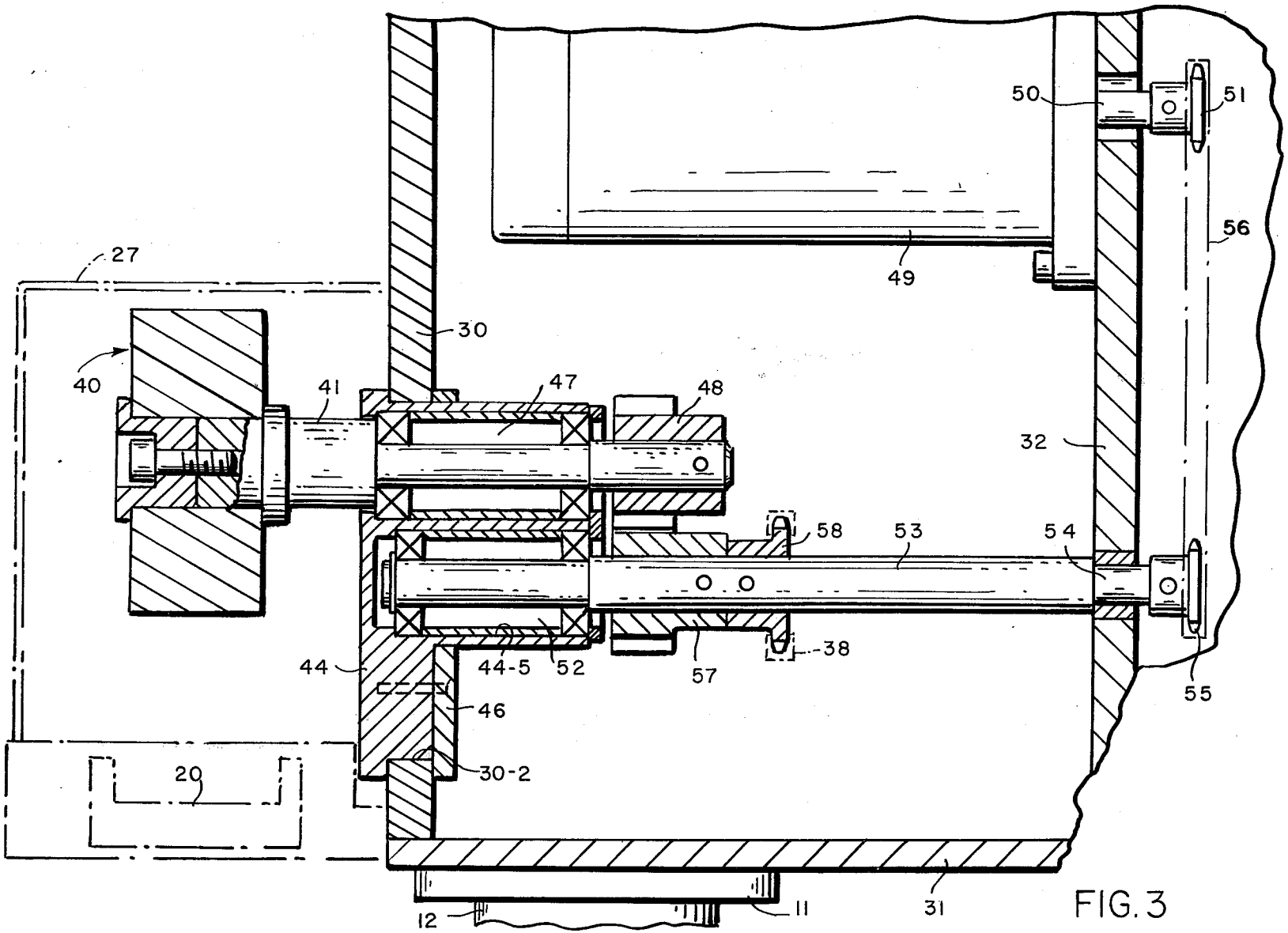
FIG. 3 is a sectional view taken along line 3—3 in FIG. 2.

As shown in FIGS. 2–6 the coder comprises a face plate 30 supported by the coder bottom 31 which in turn supports the coder rear plate 32 (see FIG. 3).

An ink roll 35 (sometimes called the fountain roll) is shown mounted on a shaft 36 which is in turn supported by a bearing assembly not shown mounted on the face plate 30 in a conventional manner. The shaft 36 supports a conventional sprocket 37 to permit inking roll 35 to be driven by a chain 38.

The inking roll 35 may be of the conventional type which comprises a metal hub 35-1 supporting a rubber cylinder 35-2 well known in the art. The function of the inking roll is to pick up ink from within the reservoir and transfer the ink to a metering roll.

In the preferred form of this invention, the metering roll is shown at 40 and is shown mounted on a shaft 41 in a conventional manner. The metering roll 40 is preferably provided with an engraved cross-hatched surface 40-1 as is conventional in the art to take up ink from the inking roll 35.

At 44 there is shown a disc assembly which is guideably supported as shown in FIG. 3 for rotation about an opening 30-2 in the face plate 30. A plate 46 is provided and joined to the disc 44 as shown in FIG. 3 to hold the disc in the hole 30-2.

Figure 5:
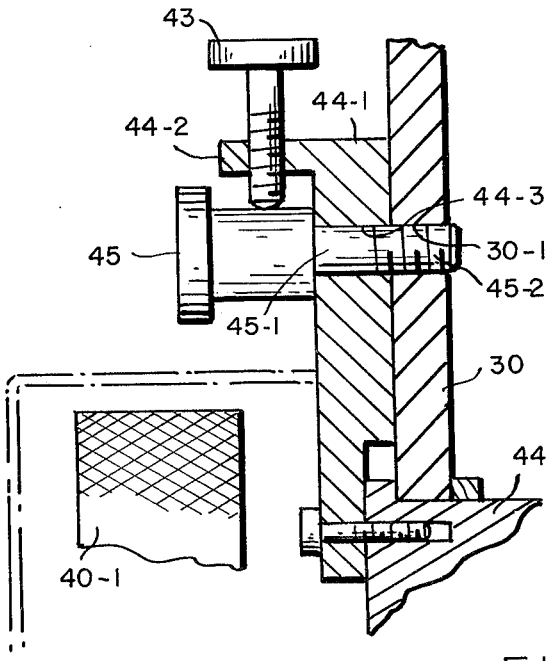
FIG. 5 is a sectional view taken along line 5—5 of FIG. 2.
Figure 6:
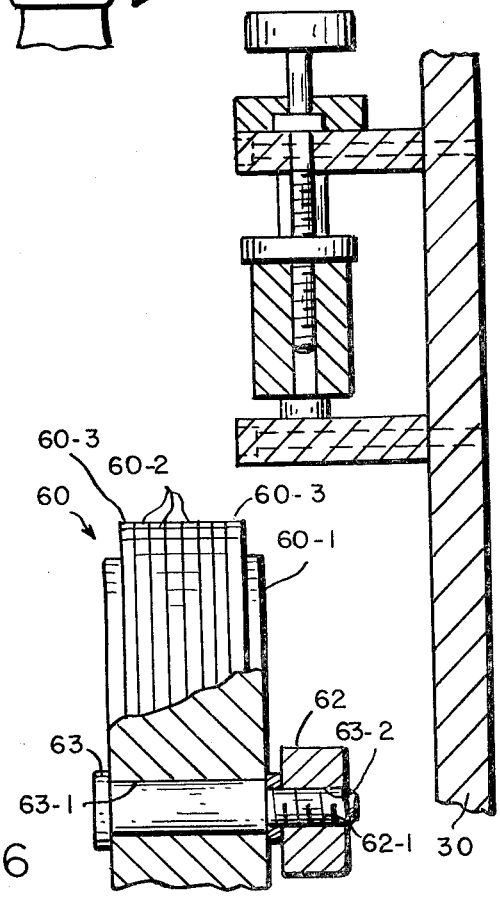
FIG. 6 is a sectional view taken along line 6—6 of FIG. 2.

As shown in FIG. 5 coupled to the face plate by screws is an adjustably positionable bar 44-1. The bar 44-1 has a slot 44-6 in which there is positioned a shaft 45-1 of a thumb-screw 45. The shaft 45-1 is threaded at 45-2 and is screwed into a threaded hole 30-1 of the face plate 30.

The disc is rotatably movable in the opening 30-2 by loosening the screw 45 after first loosening a lock screw 43 threadedly supported by flange 44-3 of the bar and conversly tightening of the screws 43 and 45 will lock the bar 44-1 in place.

The disc 44 is provided with bores 44-4 and 44-5 within bore 44-4, the shaft 41 is supported in a bearing assembly 47 for rotation. As will be seen in FIGS. 3 and 4, the shaft 41 and thus the metering roll 40 is positioned eccentrically with respect to the disc 44 center of rotation.

The metering roll shaft 41 is provided with a gear 48 which is driven via a motor 49, supported by the back plate 32. The motor shaft 50 is coupled to a sprocket 51. A shaft 53 is supported in a bearing assemblies 52 and 54 for rotation.

A sprocket 55 is coupled to the shaft 53 and the motor drives shaft 53 via chain 56 coupled to sprockets 51 and 55. A gear 57 is driven by shaft 53 and is connected to gear 48 to rotate shaft 41 and the metering roll coupled thereto.

A sprocket 58 is also mounted on the shaft for rotation therewith to drive chain 38 and thus inking roll 35. Preferably, the inking roll and metering roll are driven at a 1:1 ratio.

Thus upon rotation of the bar 44-1 and disc 44, the metering roll can be independently adjustably positioned against the inking roll 35, at the desired pressure, to insure good ink pickup.

At 60 there is shown a floating print roll which comprises a conventional hub 60-1 for supporting in a conventional manner raised indicia bearing print bands 60-2 retained by retaining bands 60-3. Ink is transferred from the metering roll 40 to the print bands as the metering roll is rotated and when the print band is not printing on the top 15-2 of the bottle cap 15-1. The print bands include indicia e.g., numbers, letters, etc., which may be set by hand and locked in place in the manner well known in the printing art.

The print roll 60 is mounted for rotation on a shaft 63-1 of a pin 63. The pin has a threaded portion 63-2 which is threadily supported in a threaded bore 62-2 of a lever 62. One end of the lever 62 is supported for pivotal motion by an arm 64-3 of an adjustably positionable pivot block 64. The lever is supported for rotation by a pin 68 (see FIG. 8).

The other lever end is resiliently biased by a resilient biasing means e.g., a spring 65 to cause the print roll 60 to engage the metering roll 40. The spring 65 is supported about a rod 66 which has a rod end 66-1. The rod end 66-1 supports the lever for rotation via a pin 67 (see FIG. 7).

The rod 66 is threaded at 66-4 and a lock nut is provided at 66-5 as a safety means to limit the downward motion of the lever 62. The rod is positioned for sideway motion as shown by arrow 81 in FIG. 2 as well as vertical motion in a rectangular slot 64-2 of flange 64-1 of the block 64. The slot 64-2 is preferably shaped to prevent motion perpendicular to arrow 81.

The upward movement of the spring 65 is limited by washer 66-3 supported by the flange 64-1. The width of the slot is less than the width of the washer 66-3 and the nut 66-5 and thus acts as a stop. The block 64 is provided with bores 64-5 and 64-6 in which there is positioned guide rods 71. The block 64 is also provided with a threaded bore 64-7 and is adjusted up or down by a thumb screw 72 having a threaded portion 72-1.

The guide rods 71 are pinned to support bracket portions 70-1 and 70-2 of a bracket 70. The bracket 70 is fixedly supported by the face plate 30 by screws (see FIGS. 2 and 6).

The thumb screw 72 is held in place by the provision of retaining collar 74 retained by the bracket 70 and the block is held in place by screw 72 which is provided with a lock nut 73 to prevent it from being rotated when tightened against block 64.

Upon loosening the lock nut 73, the thumb screw 72 may be rotated to adjust the distance between the bottle top 15-2 and the print roll 60.

Figures 2, 7, 8:
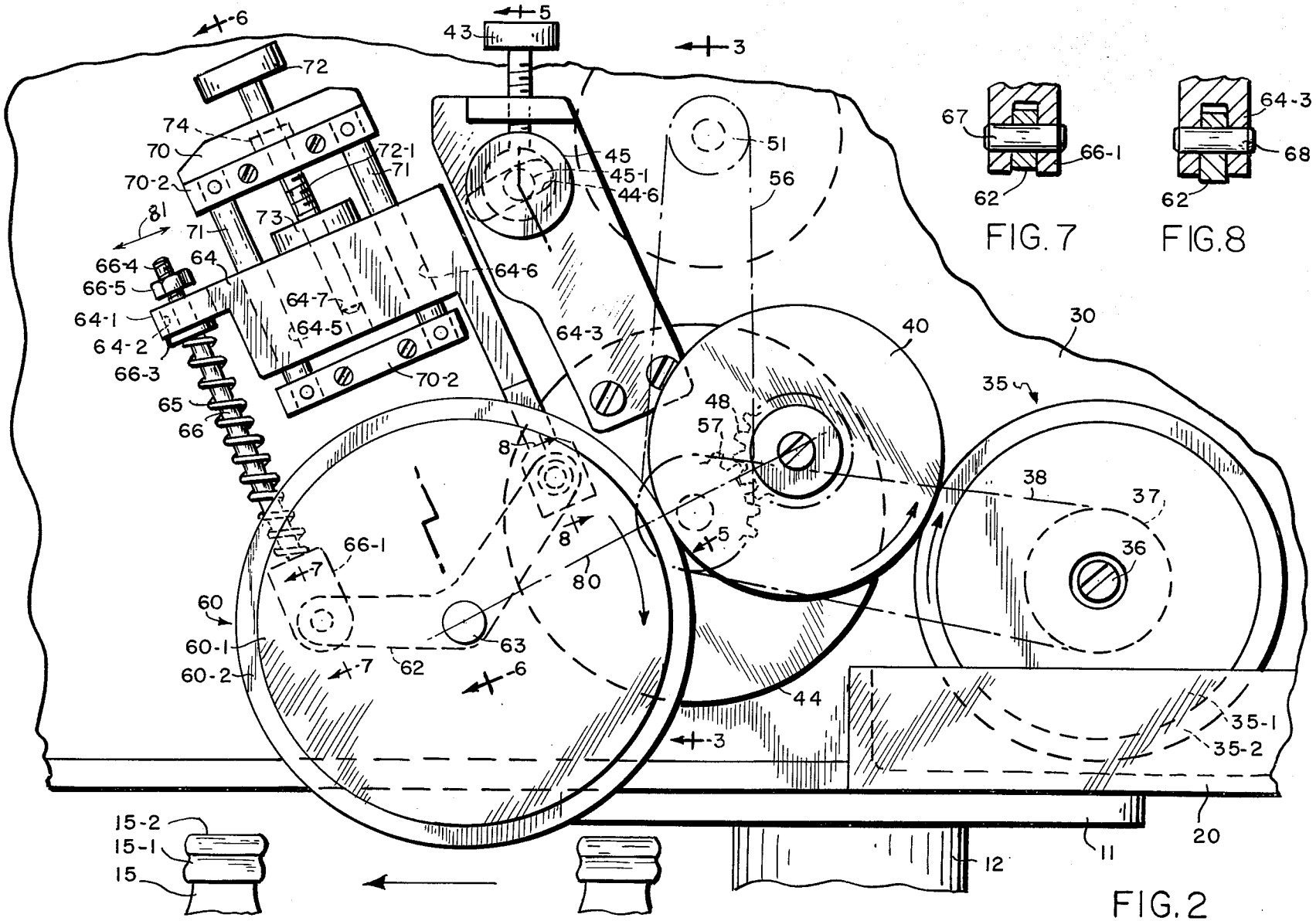
FIG. 2 is an enlarged front view of the operating parts of the coder with the cover removed.
FIG. 7 is a sectional view taken along the line 7—7 of FIG. 2.
FIG. 8 is a sectional view taken along line 8—8 of FIG. 2.

As may be observed in FIGS. 1 and 2, bottles 15 are fed on the conveyor 14 in the direction shown by the arrow. When a bottle 15 is not in contact with the print roll 60, the print roll engages the metering roll to transfer ink between the rolls.

Figure 4:
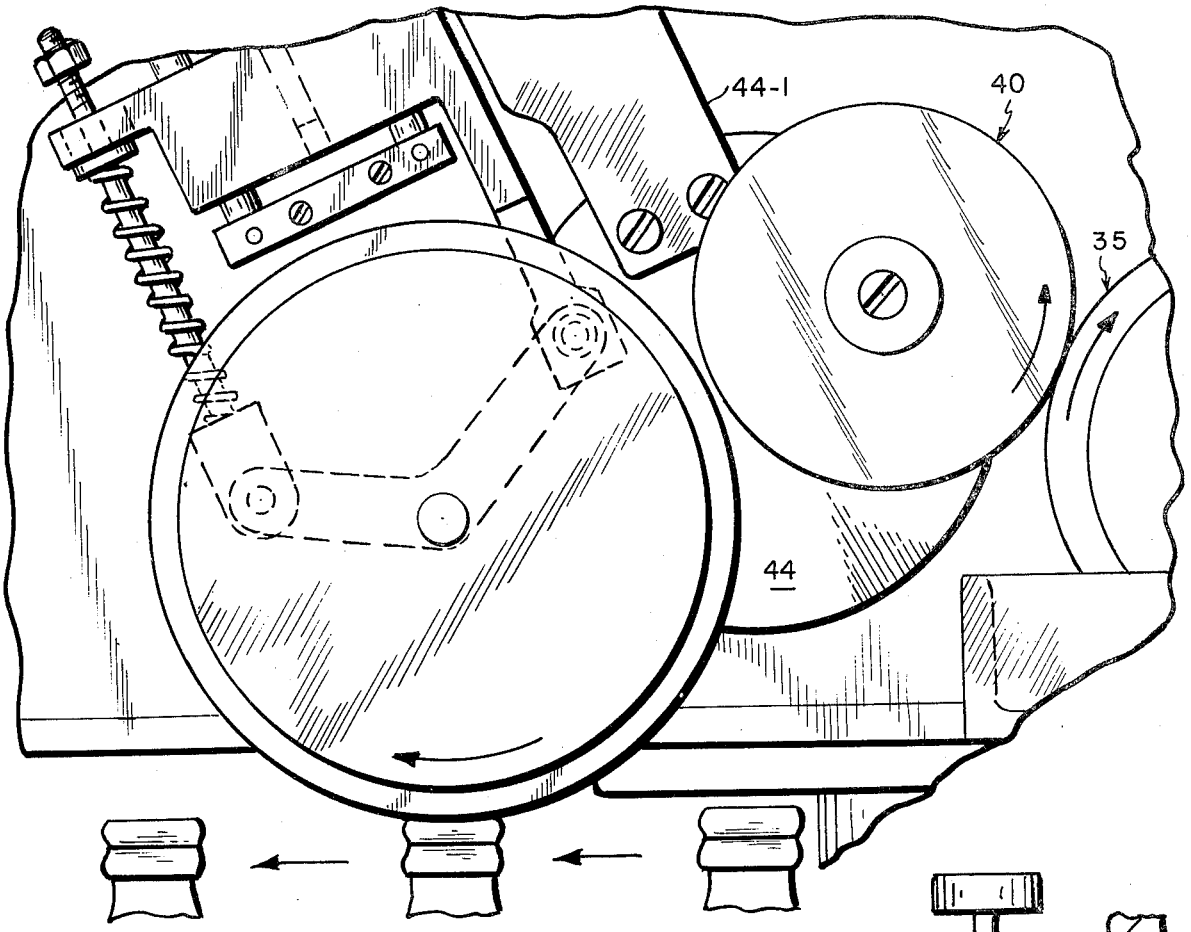
FIG. 4 is a view similar to FIG. 2 showing the coder imprinting on the cap of a bottle.

When a bottle 15 as shown in FIG. 4 comes in contact with the print roll 60, the print roll is raised against the spring 65 and the lever pivots as shown by the arrow.

As the print roll is raised, it quickly pivots and draws away from the metering roll. The print roll as shown is floating with the bottle and is rotated by the bottle 15 carried along by the conveyor 14. As the roll is rotated, indicia is applied to the cap 15-1 on the top of 15-2 thereof.

In order to insure quick release of the print roll 60 from the metering roll 40, the fixed location pivot point (lever 62 to arm 64-3) is preferably set to be above a center line 80 drawn between the center shaft of the metering roll and print roll, (see FIG. 2).

It would thus be seen that the present invention provides improvements in the art of coders. The present invention provides an independently fine tuneable, nondriven floating print roll or wheel, an independently adjustable metering roll and means for driving both of said metering roll and inking roll so that one roll does not have to drive the other.

We claim:

1. In a coder for imprinting on containers or the like, said coder including a metering roll and a printing roll supported for rotation, and said metering roll providing ink to said print roll, characterized in the improvement of said print roll being free wheeling and being supported for rotation between the ends of a lever, said print roll supported on a center shaft and said center shaft is supported by said lever, one end of said lever being pivotally supported in a fixed position, the other end of said lever being resiliently biased to urge said print roll towards said metering roll and said print roll being raisable against said resilient biasing means away from said metering roll in which rod means is pivotally coupled to said resiliently biased end of said lever and in which the rod means is supported for sideway and vertical movement and, in which a block is supported by a support bracket, said block including an arm for pivotally supporting said lever and in which said rod means is positioned in a bore of said block.

2. The coder of claim 1 in which said metering roll is eccentrically supported for rotation on a rotatable member.

3. The coder of claim 2 in which said metering roll is driven and engages an inking roll which is also driven.

4. The coder of claim 3 including means for driving in synchronism both said metering and inking rolls.

5. The coder of claim 3 in which means is provided for independently adjusting the position of the metering roll with respect to said inking roll.

6. In the top coder of claim 3 in which said inking and metering rolls are driven at a 1:1 ratio.

7. In the top coder of claim 6 in which a shaft is coupled to both of said metering and inking rolls and in which means is coupled to each of said shafts for rotating same.

8. In the top coder of claim 1 in which said inking and metering rolls are driven at a 1:1 ratio.

9. In a coder for imprinting on containers or the like, said coder including a metering roll and a printing roll supported for rotation, and said metering roll providing ink to said print roll, characterized in the improvement of said print roll being free wheeling and being supported for rotation between the ends of a lever, one end of said lever being pivotally supported in a fixed position, the other end of said lever being resiliently biased to urge said print roll towards said metering roll and said print roll being raisable against said resilient biasing means away from said metering roll in which rod means is pivotally coupled to said resiliently biased end of said lever and in which the rod means is supported for sideway and vertical movement in which a block is supported by a support bracket, said block including an arm for pivotally supporting said lever, in which said rod means is positioned in a bore of said block, and in which said block is linearily guided by said support bracket and is adjustable therein.

10. In a top coder comprising an independently driven inking roll, an independently driven metering roll and a floating non-driven printing roll, said inking roll adapted to contact said metering roll and said printing roll adapted to contact said metering roll, each of said rolls supported by a center shaft for rotation thereabout and in which said print roll shaft is supported by a lever which is in turn pivotally supported at a pivot point by a support means, said pivot point being above a center line drawn between the metering roll and the print roll so that said print roll will quickly separate from said metering roll when urged upwardly by a container.

11. In a coder for imprinting on containers or the like, said coder including a metering roll and a printing roll supported for rotation, and said metering roll providing ink to said print roll, characterized in the improvement of said print roll being free wheeling and being supported for rotation between the ends of a lever, said print roll supported on a center shaft and said center shaft is supported by said lever, one end of said lever being pivotally supported in a fixed position, the other end of said lever being resiliently biased to urge said print roll towards said metering roll and said print roll being raisable against said resilient biasing means away from said metering roll and in which said lever end which is pivotally supported in a fixed location being offset from a line between the axis of rotation of said print roll and said metering roll so that at rest said metering roll and said print roll engage each other and when a container engages said print roll and raises same, the print roll rapidly moves away from said metering roll.

12. In the coder according to claim 11 in which said metering roll is supported eccentrically by a rotatable support means, and means is provided for adjusting the position of said rotatable support means to adjust the contact pressure between said metering and print rolls.

13. The top coder of claim 12 in which said rotatable support means comprises a disc.

14. The top coder of claim 13 in which said coder includes a plate which supports said disc for rotation.

15. The top coder of claim 13 in which drive means is provided to rotate said inking roll and said metering roll.

16. The top coder of claim 13 in which said drive means includes a shaft supported for rotation by said disc, end means driven by said shaft for rotating each of said rolls.

* * * * *